United States Patent [19]

Chaney et al.

[11] 4,040,262

[45] Aug. 9, 1977

[54] ICE ANCHOR

[75] Inventors: Preston E. Chaney; George W. Morgan, both of Dallas, Tex.

[73] Assignee: Suntech, Inc., Wayne, Pa.

[21] Appl. No.: 721,250

[22] Filed: Sept. 8, 1976

[51] Int. Cl.[2] ..... E02B 1/00; B63B 21/30

[52] U.S. Cl. ..... 61/86; 61/1 R; 61/36 A; 114/294

[58] Field of Search ..... 61/86, 1, 35, 36 A; 252/155; 114/294, 311, 43; 9/8 R

[56] References Cited

U.S. PATENT DOCUMENTS

| | | | |
|---|---|---|---|
| 1,312,918 | 8/1919 | McGuckin | 52/155 |
| 2,466,692 | 4/1949 | Farrell | 114/311 |
| 3,516,379 | 6/1970 | Skoog | 114/294 |

*Primary Examiner*—Jacob Shapiro

*Attorney, Agent, or Firm*—J. Edward Hess; Donald R. Johnson; James H. Phillips

[57] ABSTRACT

An anchor frozen into an ice sheet is used primarily for propelling arctic vehicles by providing a stationary structure toward which the vehicle can be winched. The anchor includes a band of high tensile strength material formed in a closed, curved configuration for freezing into an ice sheet and attaching the vehicles thereto.

4 Claims, 5 Drawing Figures

ICE ANCHOR

BACKGROUND OF THE INVENTION

There currently is an extensive exploration effort being made in the Arctic regions of the world. It is expected that substantial drilling operations will imminently occur in such areas. Many of these areas are located in offshore areas which are ice covered for extensive periods of time during the year. Some areas are continuously ice covered throughout the year. The ice cover existing in these Arctic areas is subject to massive stresses and strains which result in a variety of configurations ranging from undisturbed sheets to rafted areas and pressure ridges. Certain shallow water areas are covered by land fast ice; i.e., ice sheets which are grounded on the sea floor. In the remainder of the offshore areas, the ice floats on top of the water and is subject to movement by both wind and current. Both the land fast ice and the floating ice are likely to break up and at least partially melt in most areas during the summer months.

Under these conditions it is apparent that conventional offshore platforms used in areas such as the Gulf Coast are fraught with problems of a magnitude which likely eliminates their use in most of the Arctic areas. Since the ice covers most of these offshore areas during the long winter season, it is not practical to use platforms or conventional drilling vessels, since they cannot be moved from one location to another. Ice breakers would be needed to create a sea lane to allow the drilling vessels to proceed to the next location or to allow barges to transport the platforms.

It has been suggested that surface effect vehicles might be used in the Arctic to provide the mobility needed for moving from one location to another. These vehicles have the capability of riding on a cushion of air over land, ice or water and can be constructed to float on water when not hovering. Currently under investigation are surface effect structures which have the capability of carrying all or part of the drilling equipment necessary for drilling exploratory wells. There have been various methods suggested for over ice movement of these structures. In small surface effect vehicles, rear mounted fans can supply sufficient propulsion to move these vehicles at high speeds. However, when surface effect structures are being used of a sufficient size to house drilling equipment, the fan power required for movement is prohibitive. Large tracked vehicles could be used for towing such a surface effect structure. These tracked vehicles tend to be less costly than utilizing a self powered surface effect structure. When it is necessary, however, to move the surface effect vehicles across an open lead in the ice, the tracked vehicles are unusable. These open leads result when tensile forces cause the ice sheet to pull apart, leaving a narrow band of open water. This open water cannot of course be traversed by a tracked vehicle. A suggestion made to obviate the problem of open leads was to tow such large surface effect vehicles by helicopters. This however, is an extremely expensive procedure due to the high amounts of fuel consumed by the helocopters. In view of the foregoing, it is clear that a cheap propulsion system capable of traversing ice sheets and ice leads is desirable for use with surface effect vehicles. It is therefore the object of the present invention to provide a new and improved method and apparatus for moving arctic vehicles in ice covered areas.

SUMMARY OF THE INVENTION

An ice anchor for providing a stationary structure on an ice sheet comprised of a generally curved band frozen into the ice sheet and having its ends joined together. An attachment mechanism located at least partially above the ice surface may be connected with the joined ends of the banded material.

DESCRIPTION OF THE PREFERRED EMBODIMENTS

Figure 1:
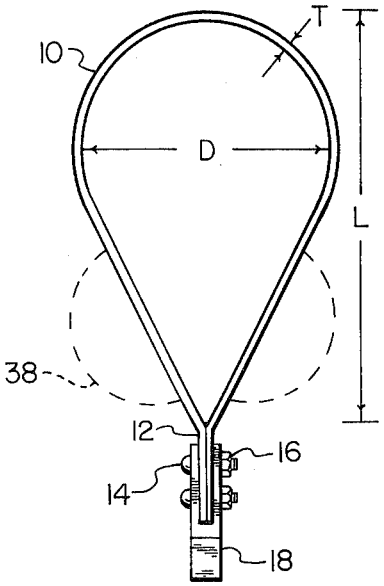
FIG. 1 is a plan view of an ice anchor.

Referring first to FIG. 1 of the drawings, an ice anchor is shown having a high tensile strength banded material 10 formed in a generally curved configuration resembling a tear drop. This banded material 10 can be made of flat plate metal, corrugated or perforated plate, expanded metal, high strength plastic materials, cross linked chains or similar materials. The banded material can be of any height, indicated as "H" in the drawing, however, it generally should be from 1 to 3 feet high and approximately $\frac{1}{8}$ to $\frac{1}{4}$ of an inch thick as indicated by "T". The diameter of the circular portion of the banded material 10 indicated as "D" can also range in size, however, it is preferably from 1 to 4 feet in diameter. The banded material 10 comes together at connection point 12 where it is connected together by bolts 14 and nuts 16 or other suitable means. An attachment section 18 is connected with the banded material 10 by these same bolts 14 and nuts 16. The attachment section 18 extends higher than the remainder of the ice anchor and is configured to receive wire line cables. The dash line 38 shown on each side of the banded material 10 represents pressure bulbs which are created in the ice when force is being applied to the ice anchor. These pressure bulbs bulbs are made up of pulverized ice which forms into the shapes shown and offer a high resistance to movement.

Figure 2:
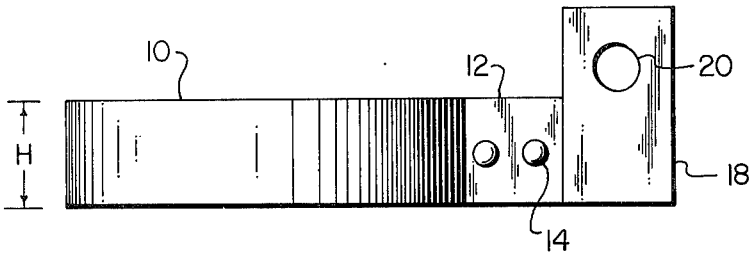
FIG. 2 is an elevational view of the ice anchor shown in FIG. 1.

A better understanding of the configuration of the ice anchor can be seen by examining FIG. 2. Here the ice anchor is shown in elevational view which more clearly describes the relative vertical position of the attachment section 18 versus the banded material 10. Located on the left side of the drawings, there is seen the banded material 10 which joins together at connection point 12. The banded material and attachment section 18 are joined together by bolts 14 and nuts located on the opposite side which are not shown. The attachment section 18 extends above the remainder of the ice anchor and has a hole 20 formed therein for easier cable attachment thereto. Besides the hole 20, it is contemplated that an overhang could be formed in the upper portion of the attachment section 18. Any other configuration which allows for easy attachment of cables would be appropriate.

In the operation of the ice anchor shown in FIGS. 1 and 2 the anchor is initially frozen into an ice sheet in a desired orientation. Usually, the orientation is determined by aligning the anchors with a predetermined course. Thus, the anchors would be available at intervals which would permit winching barges or vehicles, etc. along a selected route being followed in traversing an ice sheet. It is contemplated that these ice anchors would be especially adaptable to move large surface effect vehicles across an ice sheet. Thus, when it is desired to move such a vehicle from one location to another a winch line is run from the vehicle to an ice anchor where it is attached. Upon completion of the attachment the vehicle can be winched toward the ice anchor. Upon reaching the ice anchor the winch cable can be disconnected and attached to a subsequent anchor further down the prescribed path. The attachment to the ice anchor can be accomplished by utilizing conventional wire rope, thimbles and shackels. As the vehicles are winched toward the ice anchors, the force applied to the anchors results in the ice section encircled by the anchor being forced against the remainder of the ice sheet. When this occurs, the ice immediately adjacent the anchor tends to break up into pulverized ice particles which result in the pressure bulbs 38 shown on the sides of the banded material 10. These pressure bulbs cause a high resistance to movement of the ice anchor through the ice sheet. The tear drop design of the banded material 10 results in two of such zones which offers a higher resistance to movement than if the banded material were completely round. In a completely round anchor only one pressure bulb would be created. The high resistance to movement of the anchor enclosed ice section through the remainder of the ice sheet can be best illustrated by reference to the chart set out below. In this chart various size ice anchors were utilized in order to compare their respective resistance to ice failure. The various dimensions of the ice anchor are shown in FIG. 1 where D represents the diameter, L represents the length, and T represents the thickness of the banded material. H shown in FIG. 2 represents the height of the banded material. All of the numbers shown in the chart are expressed in inches except for the numbers representing Force Required For Failure, which is expressed in pounds.

| Diameter | Length | Height | Metal Thickness | Ice Thickness | Force Required For Ice Failure |
|---|---|---|---|---|---|
| 36 | 71 | 30 | .21 | 13.78 | 148,000 |
| 24 | 71 | 24 | .21 | 13.78 | 175,000 |
| 24 | 71 | 12 | .21 | 13.78 | 84,000 |
| 12 | 24 | 14 | 3/16(.1875) | 11.00 | 91,800 |

As can be seen from the tests performed, these ice anchors can sustain heavy loads before ice failure occurs. Due to a variation in ice strength as well as the difficulty of performing each test under the same conditions, general conclusions as to ice resistance to failure relative to anchor size is difficult. It does appear however, that an increase in the height of the banded material may provide a greater resistance to ice failure.

Figure 3:
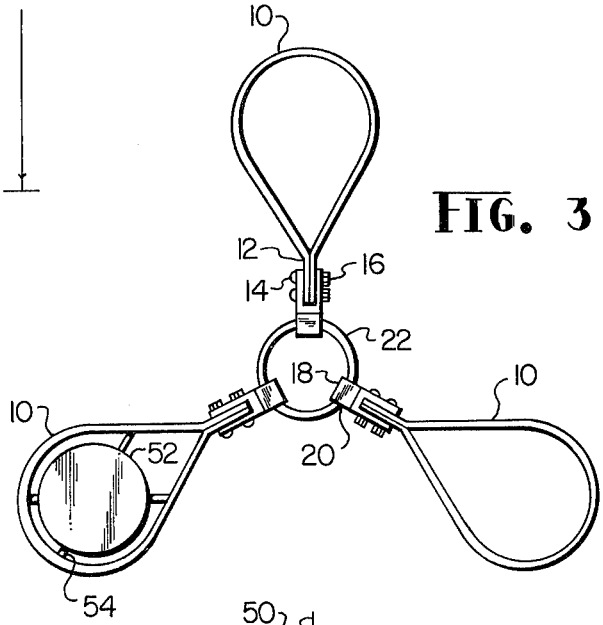
FIG. 3 is an omnidirectional configuration of an ice anchor system.

In the event that a single ice anchor is insufficient to withstand the load required, several individual anchors can be utilized. Each anchor would share a portion of the total load. In addition, if the desired orientation of the ice anchor is unknown it is possible to utilize an amnidirectional ice anchor as illustrated in FIG. 3. Here three ice anchors are shown held together by a steel band or cable 22. This steel cable is simply a means to join together the three ice anchors by passing the cable through the holes 20 in the attachment section 18. The ice anchors are of the same design as that shown in FIG. 1 in that banded material 10 is held together by bolts 14 and nuts 16. An attachment section 18 having a hole therein (not shown) is connected by the nuts and bolts joining the banded material. Shown inside of that ice anchor located on the left side of the triangular configuration is a flotation section 52 connected with the ice anchor by attachment arms 54. This flotation section 52 is utilized when the ice anchor is placed into position prior to the water freezing and could also be utilized when the ice anchor is placed in a hole cut into the ice sheet. Positioning the flotation section 52 inside the ice anchor gives the anchor more stability than if it were attached between the anchors. The flotation section 52 can be made of conventional steel barrels, bolted or welded to the ice anchors. However, to prevent loss of buoyancy caused by a leak developing in the barrel it is necessary to fill that portion of the barrel below the water line with a cellular material which acts as a solid but contains sufficient entrapped air to maintain buoyancy. After the anchor becomes frozen into position, the barrels are filled with water which freezes and gives the barrels strength to prevent their crushing when under a load.

The advantage of an omnidirectional anchor resides in its ability to accept a load from any desired direction. Additionally, an omnidirectional anchor will have a greater resistance to ice failure due to at least two of the anchor portions sharing the load.

Figure 4:
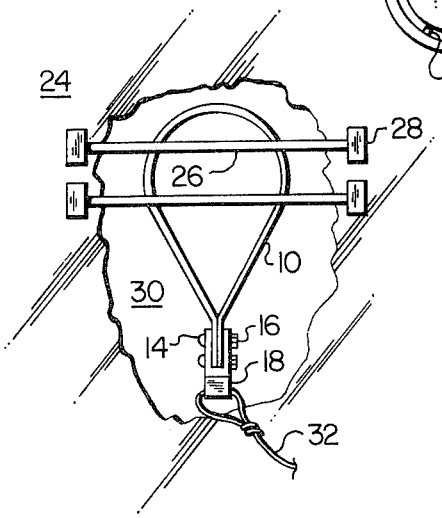
FIG. 4 is a plan view of an ice anchor suspended in a hole cut into the ice.

FIG. 4 illustrates a method of freezing in an anchor after the ice sheet has already formed. An ice sheet 24 is shown surrounding a hole in the ice indicated at 30. This hole can be created by explosives or cutting tools. An ice anchor comprised of banded material 10 connected together by bolts 14 and nuts 16 and having an attachment section 18 is shown in position in the hole fashioned in the ice sheet. Connected with the attachment section 18 is cable 32 which can be passed through a hole such as is shown in the attachment section 20 in FIG. 2. The cable 32 should be of sufficient size that it won't part until a force is exerted in excess of that necessary to cause failure of the ice sheet. The ice anchor lying in the water filling ice hole 30 is prevented from sinking by attaching rods 26 to the anchor and connecting the ends of the rods to stationary supports 28 located on the ice sheet surface. In addition, flotation elements may be placed adjacent the stationary supports 28 to insure that the equipment will not be lost if failure of the ice sheet 24 occurs.

When ice anchors are to be placed after an ice sheet has formed, a hole 30 must be cut or blasted in the ice sheet 24 to allow placement of the ice anchor. After the hole has been created the ice anchor with rods 26 attached thereto is placed in the hole 30. Since a fairly small ice anchor can withstand extremely large loads before ice sheet failure these anchors may be put in position by several methods. Vehicles small enough to operate at high speeds over the ice sheets would be able to carry a number of these small sized ice anchors. If greater mobility is desired, helicopters could be utilized to carry anchor setting crews and equipment to desired locations.

This mobility is a great advantage when surface effect vehicles must be towed across open leads in an ice sheet. In such a situation tracked vehicles could not be used. The small size of the ice anchors makes them readily transportable by helicopter to a suitable location beyond the lead. After setting the anchor, the winch line may be drawn across the lead by helicopter and attached to the anchor to enable the surface effect vehicle to winch itself across the lead. This application of the ice anchors thereby solves the vexing problem of negotating ice leads.

Figure 5:
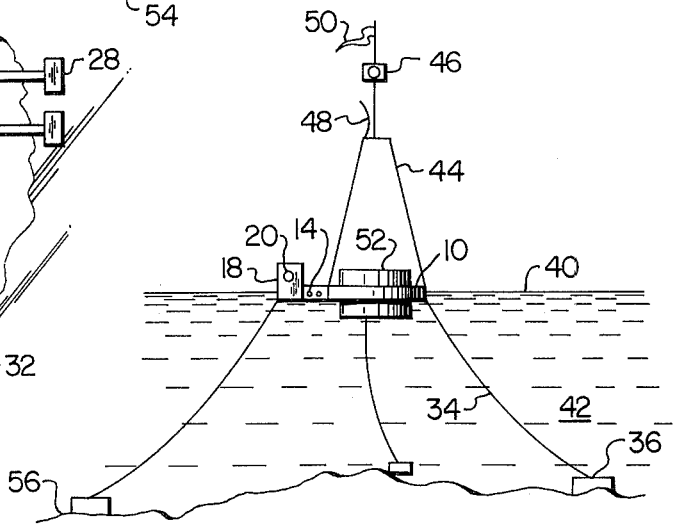
FIG. 5 is an elevational view of an ice anchor floating in position prior to freezing of the ice sheet.

FIG. 5 illustrates a typical assemblage for placement of an ice anchor in open waters during the summer. An ice anchor is shown comprising a banded material 10 connected by bolts 14 and units not shown and having an attachment section 18 with a hole 20 therein. A flotation section 52 is shown inside the banded material 10. Positioned atop the ice anchor is a frame 44 which supports a radar reflector 48, a light 46 and a pennant 50. The radar reflector 48 is of conventional design and provides a concave surface for effeciently reflecting radar signals. The light 46 can be a well insulated, battery operated light. These lights can also be powered by wind generators. Pennant 50 should be made of a material which will withstand extreme cold and high winds. The pennant should also be a readily visible color which can be seen at night. Lines 34 are attached to this assemblage and are also attached to anchors 36 located on the sea floor 56. These lines 34 should be high strength cables of a sufficiently small size that they will not negate the buoyancy effect of member 52. The anchors 36 may be made of any conventional anchoring material such as cement formed into blocks. The ice anchors 36 are located on the sea floor 56 in a manner to maintain a preselected orientation, by positioning the cement anchors in a triangular configuration.

If time and conditions permit these ice anchors can be located along any desired route during the summer season when ice has not yet formed. Because of the appreciable lag time between locating the anchors and their subsequent use it is necessary to add locating equipment to the anchor so that they can be found when they are needed. Since the ice anchors are located on a fairly precise path, the frame 44 with radar reflector 48, light 46 and pennant 50 may have a fairly low profile. Thus, this equipment may be made highly portable due to its compact size. In open water, the ice anchor with attached locating equipment and anchoring system would normally be placed by ships. In order to facilitate storage on the ship it would be advantageous to modify the frame 44 so that it can fold down in a horizontal position. To save time the flotation section 52 should be filled up to the water line with a cellular material prior to loading it aboard the vessel. With the ice anchor system in this compact form, it is transported to its selected sight and lowered into the water. The anchor lines 34 with anchor blocks 36 attached thereto are positioned in a desired orientation on the ocean floor 56. Proper buoyancy of the ice anchor is checked and any adjustments that are needed can be made by changing the position of the flotation section 52. If the frame 44 is of the fold down variety it is then raised and fixed in position by conventional means such as guy wires which are not shown. The light 46 is given an operability test to insure proper functioning.

With the ice anchor in position floating on water surface 40, it is frozen into position upon formation of the ice sheet. Once frozen into position it is available as a stationary structure for whatever purpose is desired. For example, when a large surface effect vehicle is desired to be moved from one location to another, these anchors positioned along the route to the new location can be easily utilized by attaching winch lines thereto. The frame 44 with attached locating devices can be removed or lowered to permit passage of such a vehicle over the anchor. As each ice anchor is being bypassed, a subsequent ice anchor is utilized for winching forward the surface effect vehicle. If a change in course is found to be desirable, ice anchors can be placed in position by cutting or blasting holes along the new route and implanting ice anchors in the manner described in FIG. 4.

It is readily seen that the invention may be utilized in various ways for various purposes and therefore, while particular embodiments of the present invention have been shown and described it is apparent that changes and modifications may be made without departing from this invention in its broader aspects. The aim in the appended claims is to cover all such changes and modifications which fall within the true spirit and scope of this invention.

What is claimed is:

1. Apparatus for forming an ice anchor in offshore areas covered by ice at some time during the year comprising: a banded high tensile strength material located adjacent the surface of the water and laterally enclosing a section of water in such offshore areas; buoyant float means attached to the banded material and positioned to maintain such material adjacent the water surface; attachment means connected with the banded material and located at least partially above the water surface; and means for maintaining the banded material in position relative to a selected position on the floor of the body of water.

2. The apparatus of claim 1 wherein the position maintaining means comprise a plurality of anchors arranged to prevent substantial lateral movement as well as to maintain a selected orientation of the banded material.

3. The apparatus of claim 1 wherein the banded material is configured to provide an enclosed section of water having a rear portion describing half a cylinder and a front portion describing a wedge with the leading edge of the wedge oriented vertically and directed away from the rear portion of water.

4. The apparatus of claim 3 wherein the front and rear portions of water comprise one continuous unseparated section of water.

* * * * *